United States Patent [19]

Pfister

[11] 4,341,434

[45] Jul. 27, 1982

[54] ELECTRIC PLUG CONTACT

[75] Inventor: Max Pfister, Hunenberg, Switzerland

[73] Assignee: CDM Connectors Development & Mfg. AG, Cham, Switzerland

[21] Appl. No.: 189,845

[22] PCT Filed: Feb. 12, 1979

[86] PCT No.: PCT/CH79/00022

§ 371 Date: Oct. 15, 1979

§ 102(e) Date: Oct. 15, 1979

[87] PCT Pub. No.: WO79/00635

PCT Pub. Date: Sep. 6, 1979

[30] Foreign Application Priority Data

Feb. 17, 1978 [CH] Switzerland ..... 146/78

[51] Int. Cl.[3] ..... H01R 11/22

[52] U.S. Cl. ..... 339/256 R; 339/259 R

[58] Field of Search ..... 339/217 S, 223 S, 256 R, 339/256 C, 258 R, 259 R, 262

[56] References Cited

U.S. PATENT DOCUMENTS

| | | | |
|---|---|---|---|
| 3,187,297 | 6/1965 | Gluntz | 339/217 |
| 3,467,944 | 9/1969 | Hammell et al. | 339/125 |
| 4,009,924 | 3/1977 | Bungo et al. | 339/223 S |
| 4,073,565 | 2/1978 | Raymond | 339/223 S |

FOREIGN PATENT DOCUMENTS

| | | | |
|---|---|---|---|
| 444740 | 5/1927 | Fed. Rep. of Germany . | |
| 2041065 | 2/1972 | Fed. Rep. of Germany . | |
| 1132239 | 3/1957 | France . | |
| 278735 | 2/1952 | Switzerland . | |
| 511523 | 9/1971 | Switzerland . | |
| 246700 | 2/1926 | United Kingdom . | |
| 618275 | 2/1949 | United Kingdom | 339/259 |
| 278735 | 2/1952 | Switzerland . | |
| 511523 | 9/1971 | Switzerland . | |

*Primary Examiner*—Joseph H. McGlynn
*Assistant Examiner*—Frank H. McKenzie, Jr.
*Attorney, Agent, or Firm*—Watson, Cole, Grindle & Watson

[57] ABSTRACT

An electric plug contact which includes a cylindrical contact body and a spring sleeve fixedly wrapped therearound is fabricated by rolling a metal sheet into a pipe shape to form the cylindrical contact body and then punching pairs of outwardly extending anchoring members therefrom; bending a flat metal sheet which includes perforations near its side edges into a U-shape, each of the middle part and the lateral leg parts having the shape of a circular arc extending over about 120° and so as to be conformable to the outer surface of the contact body; positioning the contact body in the U-shaped metal sheet so as to contact the middle part thereof, the anchoring members facing oppositely to the middle part; and bending the leg parts of the metal sheet to contact the outer surface of the contact body and thereby form the spring sleeve, the anchoring members fitting within separate perforations and contacting the holding portions of the spring sleeve between the associated perforations and the associated side edges thereof.

10 Claims, 14 Drawing Figures

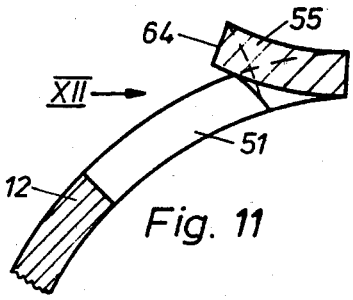
Fig. 11
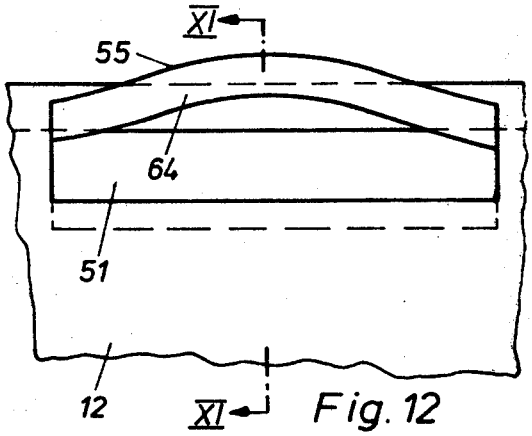
Fig. 12
Fig. 6
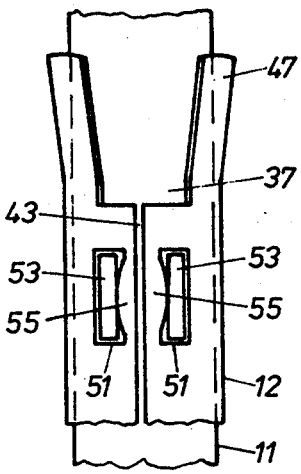
Fig. 7
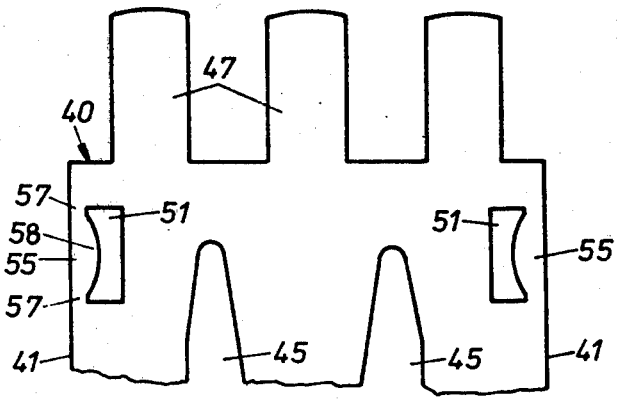
Fig. 13
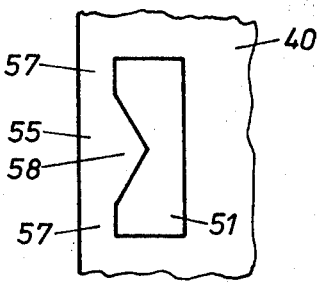
Fig. 14
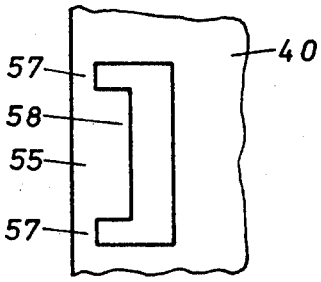

Fig. 8
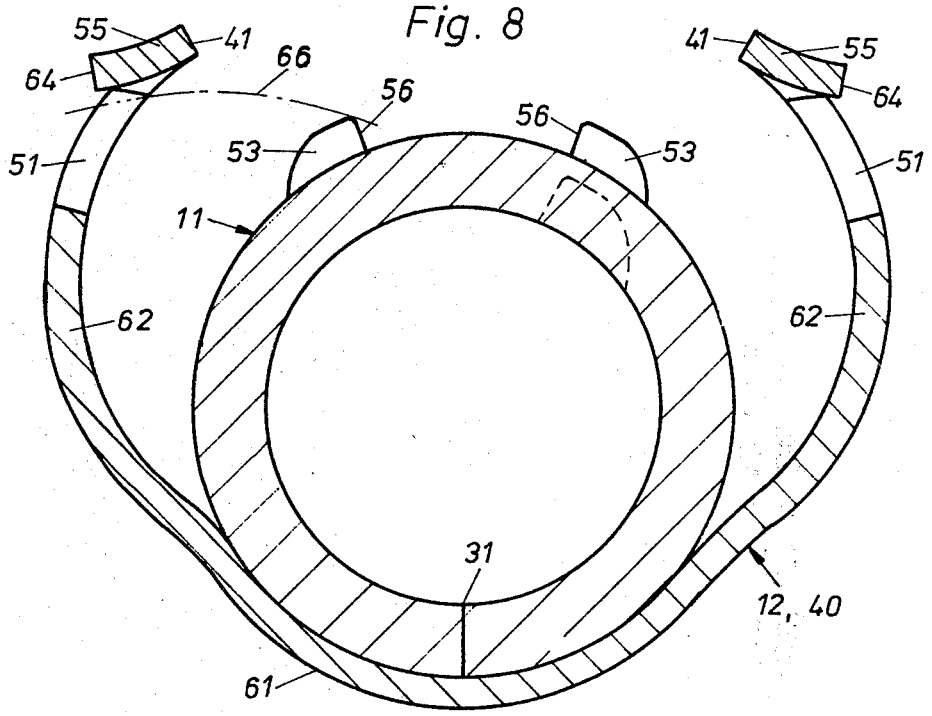
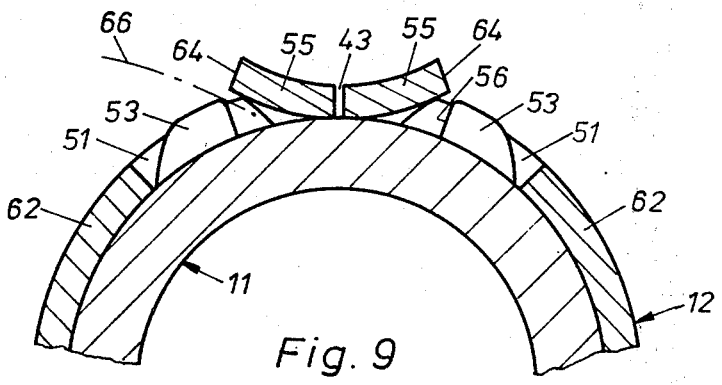
Fig. 9
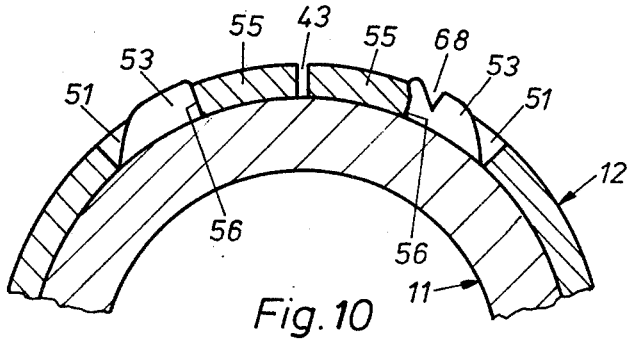
Fig. 10

ELECTRIC PLUG CONTACT

BACKGROUND OF THE INVENTION

1. FIELD OF THE INVENTION

The present invention relates to an electric plug contact which includes an electrically conductive contact body which is shaped to include an essentially cylindrical portion, and a spring sleeve which encompasses the cylindrical portion of the contact body, the cylindrical portion including anchoring projections and the spring sleeve including cooperating perforations. The present invention also relates to a method for the manufacture of such an electric plug contact.

2. THE PRIOR ART

Plug contacts of the type mentioned are known—see British Pat. No. 246,700 and Swiss Pat. No. 511,523. The contact body of the electric plug contact, which may be formed as a plug pin or as a plug sleeve, consists of an electric contact material, such as brass, copper, bronze, and it guarantees a low electric volume resistivity and a relatively high current capacity. Because of the relatively low elasticity of the contact material, the contact body may be connected in a simple manner by a squeeze or crimping connection to an electric conductor. The spring sleeve performs several functions. For one thing, it may be provided with outwardly extending tongues or flaps which permit the insertion of the plug contact into a housing of insulating material, yet will prevent the withdrawal of the plug contact from the housing due to striking against an inside shoulder of the housing. In addition, the spring sleeve may contribute to the prevention of deformation of the contact body, especially when the latter is rolled into pipe form from sheet metal material and thus includes a longitudinal joint. In the case of contact tongues formed by longitudinal slits, the spring sleeve may also function to prevent too great an outward bending of the contact tongues and/or to push the contact tongues resiliently toward the inside, i.e., in order to bring about a higher contact pressure on a contact pin introduced into the plug sleeve.

In the case of the hitherto known plug contacts of the noted type, the spring sleeve has been fixed on the contact body by flaps formed on the spring sleeve engaging with recesses in the contact body. This type of fixation is conditioned on the fact that in the case of the production of the plug contact, the spring sleeve is held in full contact with the periphery of the cylindrical part of the contact body, while the flaps are bent into the prepared recesses of the contact body. In order to make possible the bending of the flaps into the recesses of the contact body, the recesses in a direction transverse to the line of bending of the flaps must be considerably wider than the thickness of the metal sheet of the spring sleeve, i.e., wider than would be required considering only the terminal positions of the flaps. From this follows an undesirable weakening of the contact body. When the plug contact is a plug sleeve, the type of fixation used hitherto has the additional disadvantage in that the flaps of the spring sleeve must be relatively short so that they will not project into the inside space of the contact body intended for the reception of a plug pin, in which event the anchoring of the spring sleeve on the contact body is relatively uncertain, such that when the plug sleeve is used the longitudinal joint of the spring sleeve may possibly burst open. This, to be sure, could be avoided by interconnecting the parts of the spring sleeves themselves adjoining the longitudinal joint in a positive manner by making flaps on one portion of the sleeve engage with recesses in the other portion of the sleeve and by bending the flaps back. However, such a plug contact is more complicated in construction and more expensive to produce, and local enlargements of the outside dimensions of the spring sleeve develop due to the superposed portions of the spring sleeve and of the flaps, which in some cases is a disadvantage.

It is an object of the present invention to provide an electric plug contact which avoids the disadvantages of known electric plug contacts, as described, and wherein a perfect connection will be guaranteed between the spring sleeve and the contact body, without any flap-shaped parts of the spring sleeve projecting into the inside of the contact body and without enlarging the outside diameter of the spring sleeve by superposed portions of the sleeve. Furthermore, it is an object of the invention to provide a plug contact which can be produced in a relatively simple and economical manner. Finally, it is also an object of the present invention to provide an effective, relatively simple and economical method for the production of the plug contact, by which process a safe fixation of the spring sleeve on the contact body is made possible.

SUMMARY OF THE INVENTION

According to the present invention the perforations in a flat metal sheet used to form the spring sleeve will be suitably located and shaped that when the flat metal sheet is bent to wrap around the outer surface of the cylindrical portion of a contact body to form the spring sleeve, the anchoring projections on the cylindrical portion of the contact body will extend into these perforations and will, indeed, be firmly wedged against the holding portions of the so-formed spring sleeve which are provided between the perforations and the adjacent side edges of the spring sleeve.

The invention and its advantages will now be further explained in more detail with reference to specific embodiments shown in the attached drawings.

BRIEF DESCRIPTION OF THE DRAWINGS

FIG. 6 shows, on an enlarged scale, a portion of the plug sleeve in FIG. 1 as seen in the direction of arrow VI;

FIG. 7 shows a partial view of a flat sheet metal blank which is used in the formation of the spring sleeve portion of the inventive electric plug contact;

FIGS. 8, 9 and 10 are illustrations showing various steps in the method of production of the inventive electric plug contact;

FIG. 11 shows a cross sectional view through a portion of the spring sleeve of FIG. 12 as seen along line XI—XI;

FIG. 12 shows a view of the same portion of the spring sleeve viewed in the direction of the arrow XII in FIG. 11;

FIGS. 13 and 14 show portions of embodiments of sheet metal blanks useful in forming the spring sleeves for the inventive electric plug contact.

DETAILED DESCRIPTION OF THE PREFERRED EMBODIMENTS

Figure 1:
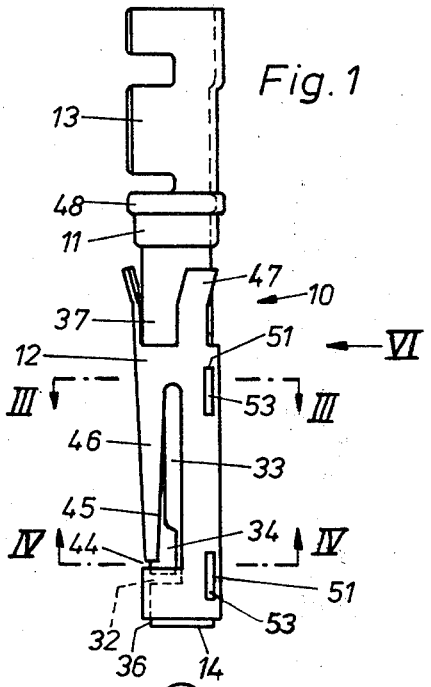
FIG. 1 shows a side view of an inventive electric plug contact constructed in the form of a plug sleeve.
Figure 2:
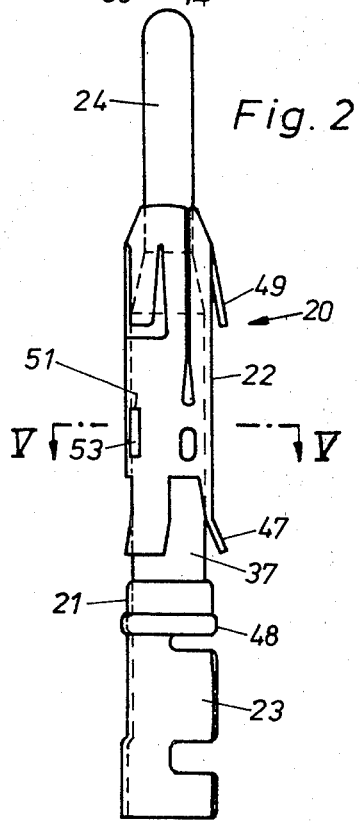
FIG. 2 shows an analogous illustration of an inventive electric plug contact constructed in the form of a plug pin.

The electric plug socket 10 shown in FIG. 1 consists of an essentially pipe-shaped contact body 11, which is made of electrically conductive contact material, e.g., brass, copper or bronze, and a spring sleeve 12, which is formed from a metallic spring plate, the spring sleeve 122 surrounding the contact body 11 on the outside. One end portion of the contact body 11 is formed as a connecting terminal 13 that is U-shaped in its cross section to allow for insertion of an electric conductor (not shown). The electric conductor may be connected mechanically and electrically to the contact body 11 by, e.g., crimping the connecting terminal 13. The opposite end of the contact body 11 has a mouth 14 for the introduction of the plug pin 20 as shown in FIG. 2. Details of the plug sleeve 10 are further explained below.

The electric plug pin 20 shown in FIG. 2 consists of a contact body 21, which is made of electrically conductive material, and a spring sleeve 22, which is formed from a metallic spring plate, the spring sleeve 22 surrounding the contact body 21 on the outside. One end portion of the contact body 21 is formed as a connecting terminal 23 for insertion of an electric conductor (not shown) which, e.g., may be connected mechanically and electrically with the contact body 21 by squeezing the connecting terminal 23. The other end portion of the contact body 21 is formed as a contact pin 24, which may be introduced through the aperture 14 into the plug sleeve 10. Details of the plug pin 20 will be further described below.

The construction of the plug sleeve 10 will now be explained in more detail. The contact body 11 is rolled from a metal sheet so as to be shaped as a pipe having a longitudinal joint 31 where the opposite cutting edges of the metal sheet abut, as can be clearly seen in FIGS. 3 and 4. The sheet metal includes cut outs such that the formed contact body 11 has a transverse slit 32 and two longitudinal slits 33 which are disposed symmetrically in relation to the longitudinal joint 31 and form together with the longitudinal joint 31 two contact fingers 34 which run side by side in the longitudinal direction of the contact body 11 and which are resilient in a radial direction, i.e., towards and away from the longitudinal axis of the contact body 11. Furthermore, the two longitudinal slits 33 are disposed in such a way that a part 35 of the contact body which is opposite the two contact fingers 34 will extend over about half the periphery of the contact body 11 and thus will be practically inflexible in a radial direction. The cutting edges of the part 35 of the contact body adjoining the longitudinal slits 33 each constitute a stop for the free end portion of one or the other contact finger 34 and will limit the mobility of the contact fingers to the inside. Between the end of the contact body 11 having the aperture 14 and the cross slit 32, the contact body has a cylindrical portion 36 which is closed along its entire circumference. An analogous cylindrical portion 37 of the contact body 11 is located at the opposite end of the longitudinal slits 33.

Figure 3:
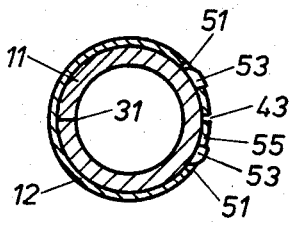
FIG. 3 shows, on an enlarged scale, a cross sectional view of the plug sleeve in FIG. 1 as seen along line III—III.
Figure 4:
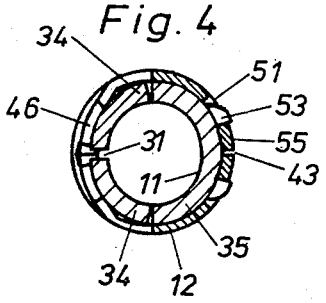
FIG. 4 shows an analogous cross sectional view of the plug sleeve in FIG. 1 as seen along line IV—IV in FIG. 1.

The spring sleeve 12 is rolled in the manner of a pipe from a flat blank 40 of a metallic spring plate (FIG. 7) so that the opposite cutting edges 41 of the flat metallic blank are positioned closely to one another to provide a longitudinal joint 43 in the formed spring sleeve, as FIGS. 3, 4 and 6 clearly show. The longitudinal joint 43 of the spring sleeve 12 lies diametrically opposite the longitudinal joint 31 of the contact body 11, as FIGS. 3 and 4 clearly show. The flat blank 40 includes cut outs such that the formed spring sleeve 12 has a cross slit 44 and two longitudinal slits 45 communicating with the former in order to form a tongue 46 which is diametrically opposed to the longitudinal joint 43 and is shaped such that, due to its elasticity, it exerts a pressure on the contact fingers 34 of the contact body 11 and forces these fingers toward the inside. The end of the spring sleeve 12 facing away from the aperture 14 of the contact body 11 has several locking flaps 47 which extend outwardly from the contact body 11 and which, together with an outside bulge 48 of the contact body, serve for the purpose of holding the plug sleeve 10 firmly in a housing of insulating material (not shown), as is familiar to the expert.

In order to fix the spring sleeve 12 on the contact body 11 against twisting and against axial shifting, the following means and measures are utilized: as seen in FIGS. 1, 3, 4 and 6, the spring sleeve 12 includes a perforation 51 on each of its portions adjoining the longitudinal joint 43 and lying within the area of the cylindrical portions 36 and 37 of the contact body, and lockingly anchored in each perforation 51 is an anchoring member 53 of the contact body 11. The anchoring members 53 are located on the side of the contact body facing away from the longitudinal joint 31 of the contact body 11. The perforations 51 are each disposed at a distance from the adjacent cutting edge 1 (FIG. 7) of the sheet metal blank 40 forming the spring sleeve 12 so that there remains a holding bridge 55 of sufficient strength between each perforation 51 and the longitudinal joint 43 (or associated side edge) of the spring sleeve. These holding bridges 55 of the spring sleeve 12 and the flank (sides) 56 of the anchoring elements 53 of the contact body 11 facing the longitudinal joint 43 will be in contact such that the spring sleeve 12 will be tensely held flush around the periphery of the cylindrical portions 36 or 37 of the contact body 11, and as a result will be secured against twisting in relation to the contact body. The dimensions of the perforations 51 and the anchoring elements 53 will approximately correspond in the direction parallel to the longitudinal axis of the plug sleeve 10, as a result of which the spring sleeve 12 will be secured even against axial shifting on the contact body 11. Preferably, the perforations 51 and the anchoring elements 53 are disposed symmetrically in relation to a plane which contains the longitudinal axis of the plug sleeve 10 and which passes through the middle of the longitudinal joint 43 of the spring sleeve 12.

The fixation of the spring sleeve 12 on the contact body 11 is particularly good whenever the flanks 56 facing the longitudinal joint 43 of the spring sleeve each run approximately in a plane which contains the longitudinal axis of the cylindrical portion 36 or 37 of the contact body and stands radially in relation to the cylindrical portion, as shown most clearly in the FIGS. 8 and 10. For a reason which will be explained, it is of advantage furthermore to assign a lesser width in the circumferential direction of the spring sleeve 12 at its axial end portions 57 than in its middle portion 58, in order that only the latter will be in contact with an associated anchoring element 53, as FIG. 6 shows. The height of each anchoring element is only slightly greater than the thickness of the spring plate forming the spring sleeve 12.

The production of the plug sleeve 10, as described, is effectively accomplished according to the following method:

The contact body 11 with the anchoring elements 53 is prefabricated by rolling a properly shaped blank of sheet metal in a manner known per se and the anchoring elements 53 are produced by outwardly punching portions of the rolled (pipeshaped) metal sheet by a press die operating from inside the rolled metal sheet preferably with the help of a stamping matrix (not shown).

For the formation of the spring sleeve 12, a flat blank of the metallic spring plate 40 (FIG. 7) is prepared, which at opposite edge portions is provided with perforations 51 (thus to provide holding bridges 55). The prepared sheet metal blank 40 is bent first of all into a U-shape which, according to FIG. 8, provides a middle part 61 and two lateral leg parts 62. Both the middle part 61 as well as each of the lateral leg parts 62, viewed in cross section, are bent so that each extends over about 120°, thereby each part will be ultimately adapted to conform to the curvature of the peripheral surface of the cylindrical portions 36 and 37 of the contact body 11. In the above-mentioned U-shape, the opposite edges 41 of the blank 40 of the sheet metal have a distance from one another which is about equal to the outside diameter of the contact body 11. During the formation of the above described U-shape, each of the holding bridges 55 is twisted such that its lateral edge 64 adjacent to the perforation 51 and facing away from the lateral edge 41 of the blank 40 of sheet metal, will extend further to the outside than the remaining part of the pertinent leg part 62 containing the perforation 51, as can be seen clearly in FIGS. 8, 11 and 12. This twist of the holding bridge 55 is facilitated by the fact that the width of each hold back bridge in its axial end portion 57 is smaller than it is in its middle portion 58. Thus, above all, the lateral edge 64 of the middle portion 58 is the one which is displaced to the outside.

The prefabricated contact body 11 is inserted along and between the leg parts 62 into the U-form of the blank 40 of the metal sheet formed in the manner described, whereby the portion of the contact body 11 having the longitudinal joint 31 is brought into contact with the middle part 61. The anchoring elements 53 of the contact piece 11 at the same time face away from the middle part 61. Subsequently, the two internal leg parts 62 are swivelled up laterally to contact the outer surface of the contact body 11 for the purpose of finishing the spring sleeve 12. By this operation, the lateral edges 64 of the holding bridges displaced to the outside by the twist of the holding bridges 55, viewed in cross section according to FIG. 8, move approximately along circular arcs 66 just barely over the anchoring elements 53 of the contact body 11. When the leg parts 62 have been brought completely into contact with the contact body 11, as FIG. 9 shows, the originally opposite lateral edges 41 of the blank 40 of sheet metal are positioned closely adjacent each other in order to form the longitudinal joint 43 of the spring sleeve 12 and the anchoring elements 53 are within the associated perforations 51. Whereas the leg parts 62 further remain forced laterally against the contact body 11, the twisted holding bridges 55 are subsequently forced back into their original form and are made to fit against the contact body 11. At the same time, the lateral edges 64 of the holding bridges 55, previously displaced to the outside, come into locking engagement with the radially running flanks 56 of the anchoring elements, as illustrated in the left half of FIG. 10. By this operation, the lateral edges 64 of the holding bridges 55 are wedged together with the flanks 56 of the anchoring element 53 so that the spring sleeve 12 is held flush against the contact body when the lateral pressure on the leg parts 62 is finally released.

Although by the method described a sufficiently firm seat of the spring sleeve 12 on the contact body 11 may be achieved, a recess 68 (FIG. 10, right half) may be additionally impacted into the tops of some or all anchoring elements 53 by driving the end of a calking tool into the top of the pertinent anchoring element. As a result, the flank 56 of each anchoring element so treated will be pushed in the direction toward the longitudinal joint 43 and against the associated holding bridge 55, such that the spring sleeve is even more tightly fixed around the contact body 11.

According to FIGS. 6 and 7, the lateral edge of the middle portion 58 of each perforation 51 cooperating with the radial flank 56 of an anchoring element 53 is approximately circularly arched. However, other types of embodiments are also possible, e.g., wherein the holding portions will have triangularly shaped heads or rectangularly shaped heads, as illustrated in FIGS. 13 and 14.

Figure 5:
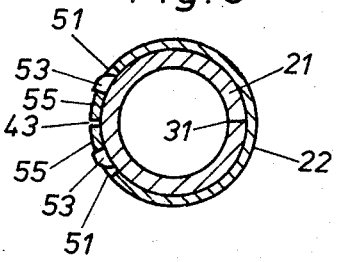
FIG. 5 shows an analogous cross sectional view of the plug pin in FIG. 2 as seen along line V—V.

The construction of the plug pin 20 according to FIGS. 2 and 5 will now be explained in detail. The contact body 21 is rolled from a flat sheet metal blank and, just like the contact body 11 of the plug sleeve 10, will have a longitudinal joint 31 (FIG. 5). The spring sleeve 22 encircling the contact body 21 is rolled from a blank of spring plate (not separately shown) and, like the spring sleeve 12 of the contact sleeve 10, has a longitudinal joint 43 (FIG. 5) which lies diametrically opposite the longitudinal joint 31 of the contact body 21. The end portion of the spring sleeve 22 facing away from the contact pin 24 forms several locking flaps 47, which are spread away from the contact body 21 and serve in a known manner, together with an outside bead 48 of the contact body, for holding the plug 20 firmly in a housing of insulating material (not shown). At the other end portion of the spring sleeve 22 there are several outwardly extending spring tongues 49 which serve for centering the contact pin with respect to a recess of the above-mentioned housing of insulating material, accomodating the plug pin 20.

The spring sleeve 22 is fixed on the contact body 21 in an analogous manner as the spring sleeve 12 on the contact body 11. The portions of the spring sleeve 22 adjacent to the longitudinal joint 43 each have a perforation 51 with each anchoring element 53 of the contact body 21 in locking engagement, as shown most clearly in FIG. 5. A holding bridge 55 is disposed between each perforation 51 and the longitudinal joint 43, which bridge in cooperation with the pertinent anchoring element 53 holds the spring sleeve 22 tensed around the circumference of a cylindrical portion 37 of the contact body 21. The shape and arrangement of the perforations 51 and of the anchoring elements 53 are in detail exactly as has been fully described with reference to the plug sleeve 10. Likewise, the method for the production of the plug pin 20 is completely analogous to the method described above for the production of the plug sleeve 10, and therefore no further explanations are needed.

The plug contacts 10 and 20, as described and as compared to known embodiments, have the advantage that the spring sleeve 12 or 22 is fixed perfectly on the contact body 11 or 21 by the perforations 51 of the spring sleeve and the anchoring elements 53 of the contact body 11 or 21 extending into the perforations 51. It is also of advantage that none of the parts serving for fixing project into the inside of the contact body 11 or 21, or project noticeably beyond the outside periphery of the spring sleeve 12 or 22. An essential advantage furthermore is the fact that the production method described is relatively simple and leads safely to perfect plug contacts. As a result of the twisting of the holding bridge 55, as described, during forming the parts 61, 62 of the blank of the spring plate, the advantage results that in the subsequent operation of laterally pressing the leg parts 62 against the contact body 11 or 21, the holding bridges 55 may be moved easily over the anchoring cams 53. However, a variation of the method is also possible, wherein the twisting of the holding bridges 55 is omitted and the latter are simply forced over the anchoring cams 53 during the lateral pressure of the leg parts 62 against the contact body 11 or 21, whereby a temporary elastic or partly elastic deformation of the holding bridges 55 takes place and they finally snap behind the anchoring cams. By wedging the anchoring cams 53 after the latter have been brought into engagement with the perforations 51 of the spring sleeve 12 or 22, it is possible to achieve an even firmer seat of the spring sleeve on the contact body 11 or 21 in a simple manner.

We claim:

1. An electric plug contact which includes an elongated, electrically conductive contact body, said contact body including a cylindrical portion having at least one pair of anchoring members extending outwardly therefrom, and an elongated spring sleeve wrapped around the cylindrical portion of the contact body, the spring sleeve having side edges which are closely positioned along a longitudinal line extending between each pair of anchoring members, the spring sleeve including pairs of perforations therein at least equal in number to the number of pairs of anchoring members on the contact body, each perforation of each pair of perforations being located near an opposing side edge of the spring sleeve so as to create a holding bridge portion between the perforation and the associated side edge, each perforation being located and shaped such that an associated anchoring member is located therein in continuously wedged relationship against the associated holding bridge portion of the spring sleeve.

2. The electric plug contact as defined in claim 1 wherein each holding portion of the spring sleeve has a center portion and opposite end portions, and wherein each perforation is shaped such that the center portion of each holding bridge portion of the spring sleeve extends further from the associated side edge of the spring sleeve than the opposite end portions, the center portion being wedged against an associated anchoring member.

3. The electric plug contact as defined in claim 2 wherein the center portion of each holding portion exceeds away from the associated side edge of the spring sleeve with a triangularly-shaped head.

4. The electric plug contact as defined in claim 2 wherein the center portion of each holding portion extends away from the associated side edge of the spring sleeve with a rectangularly-shaped head.

5. The electric plug contact as defined in claim 1 wherein the spring sleeve has a predetermined thickness, and wherein each anchoring means extends outwardly of the associated cylindrical portion a distance approximately equal to the predetermined thickness.

6. The electric plug contact as defined in claim 1 wherein each anchoring member of each pair of anchoring members includes a flat side surface facing the other associated anchoring member.

7. The electric plug contact as defined in claim 6 wherein the flat side surface of each anchoring member lies in a plane which extends radially through the longitudinal axis of the cylindrical portion.

8. The electric plug contact as defined in claim 6 wherein each anchoring member includes a top surface containing an indentation.

9. The electric plug contact as defined in claim 1 wherein the perforations of each pair of perforations are identically shaped and are spaced an equivalent distance from the associated side edge of the spring sleeve.

10. The electric plug contact as defined in claim 1 wherein each of the anchoring members is elongated in the longitudinal direction of the elongated contact body and each of the perforations is elongated in the longitudinal direction of the elongated spring sleeve, and wherein the anchoring members and the perforations have approximately equal elongated lengths such that the elongated spring sleeve is axially fixed in position with respect to the elongated contact body.

* * * * *

UNITED STATES PATENT AND TRADEMARK OFFICE

CERTIFICATE OF CORRECTION

PATENT NO. : 4,341,434

DATED : July 27, 1982

INVENTOR(S) : Max Pfister

It is certified that error appears in the above-identified patent and that said Letters Patent are hereby corrected as shown below:

On the title page Insert

--[30] FOREIGN APPLICATION PRIORITY DATA

February 17, 1978 [CH] Switzerland.....1746/78 --

Signed and Sealed this

First Day of March 1983

[SEAL]

*Attest:*

GERALD J. MOSSINGHOFF

*Attesting Officer*

*Commissioner of Patents and Trademarks*